US006398027B1

(12) United States Patent
Ryu

(10) Patent No.: US 6,398,027 B1
(45) Date of Patent: Jun. 4, 2002

(54) COSMETIC BRUSH CASE

(76) Inventor: Bu Kwang Ryu, Hwaseong Village 707-405, Mokryeonmaeul, Yatap-dong 185, Bundang-gu, Seongnami-shi, Kyeonggi-do (KR)

( * ) Notice: Subject to any disclaimer, the term of this patent is extended or adjusted under 35 U.S.C. 154(b) by 0 days.

(21) Appl. No.: 09/580,021

(22) Filed: May 26, 2000

(30) Foreign Application Priority Data

Jul. 27, 1999 (KR) ..... 99-30693

(51) Int. Cl.[7] ..... B65D 85/24
(52) U.S. Cl. ..... 206/362; 206/372
(58) Field of Search ..... 206/235, 581, 206/361, 362, 15.2, 15.3, 1.7, 443, 372, 373, 349, 379; 211/65, 69; 132/313–316

(56) References Cited

U.S. PATENT DOCUMENTS 4,331,168 A * 5/1982 Hatakeyama ..... 206/581
4,574,944 A * 3/1986 Gregory ..... 206/235
4,598,822 A * 7/1986 Hemmings ..... 206/379
4,815,483 A * 3/1989 DuGrenier et al. ..... 132/314
4,929,427 A * 5/1990 Guala ..... 206/443
5,813,533 A * 9/1998 Knoblauch ..... 206/379

* cited by examiner

*Primary Examiner*—Luan K. Bui
(74) *Attorney, Agent, or Firm*—Knobbe Martens Olson & Bear LLP

(57) ABSTRACT

The cosmetic brush case includes an upper cover, a lower cover, and a plurality of brush holders. The upper cover, lower cover and holders are connected by a hinge pin so that they can rotate about the pin. Each holder retains each of brushes. One of two adjacent holders has a protrusion extending toward the other of the holders. The other of the holders has an arc-shape groove for receiving the protrusion. The protrusion can move along the groove when the one of the two holders rotates. After the protrusion reaches an end of groove two adjacent holders rotates together. By the above constitution, the holders can be spread out in a fan shape when the case is opened.

21 Claims, 10 Drawing Sheets

COSMETIC BRUSH CASE

FIELD OF THE INVENTION

This invention relates to a cosmetic brush case for retaining plural cosmetic brushes, more particularly to, a compact cosmetic brush case allowing cosmetic brushes to spread in a fan shape when the case is opened, being capable of protecting the brushes from damages, and being convenient in the operation.

BACKGROUND OF THE INVENTION

In general, cosmetic brushes are put into a container of a barrel type. Various kinds of cosmetic brushes are put in the container standing on a desk. The barrel container standing on the desk is unstable. The brushes may be poured out when the container falls. Furthermore, it is inconvenient since locations of the brushes are not fixed and some of brushes may stand closely. Additionally, the container is not suitable for carrying. It is difficult to keep the brushes clean since brushes are exposed in the air even after using. If the contaminants and dust are adhered to the brushes, it is difficult to clean them, since cosmetic materials of high viscosity are generally adhered on the brushes.

Also, a case of a wallet type has been widely used. The case made with a soft leather sheet or a vinyl sheet is designed to have plural receiving partitions, each of them receiving grip of each of the cosmetic brushes. When the case is folded, the cosmetic brushes are not exposed outside, and the case containing the brushes can be easily carried. However, the wallet type case is considerably inconvenient in the opening operation, which is required of the case before using the brushes, and in a rearrangement operation of the brushes, which is required after using. It may take much time to perform the above operations. In addition, it is inconvenient to take out the brushes or to put the brushes in. Moreover, a hair portion of each brush may be damaged when since the wallet type case is pressed or transformed during carrying. If the wallet type case is oriented for the hair portion of the brush to be directed downward, end portion of the hair portion may be damaged since the by being is pressed by the weight of the brush itself. Therefore, the wallet type case is not suitable for the safekeeping of the cosmetic brushes.

SUMMARY OF THE INVENTION

Accordingly, it is an object of the present invention to provide a cosmetic brush case, which is convenient in operation and use of cosmetic brushes.

It is another object of the present invention to provide a cosmetic brush case, which keeps a stable state during using the brushes.

It is a further object of the present invention to provide a cosmetic brush case, which is convenient in carrying and prevents hair portions of the brushes from being damaged or transformed during carrying.

The above and other objects of the present invention are accomplished by providing a cosmetic brush case comprising:

a brush case for retaining plural brushes, the case comprising:

a first cover;

a second cover coupled to the first cover and rotatable about an axis with respect to the first;

a plurality of brush holders being arranged along the axis and rotatable about the axis;

wherein, when the case is closed, the holders are gathered and covered by the first cover and the second cover; and wherein, when the case is opened, the holders are rotated to be spread out.

BRIEF DESCRIPTION OF THE DRAWINGS

The foregoing and other objects and features of the present invention will become more fully apparent to those skilled in the art from the following description of embodiments taken in conjunction with the accompanying drawings, wherein.

DETAILED DESCRIPTION OF THE PREFERRED EMBODIMENTS

Figure 1:
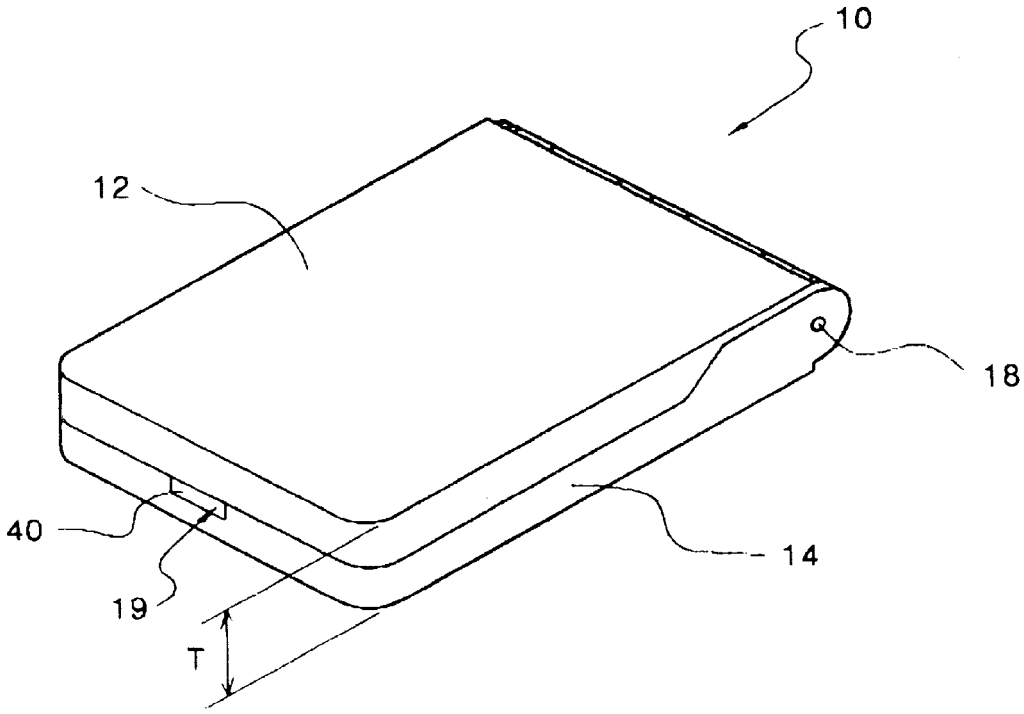
FIG. 1 is a perspective view of a compact cosmetic brush case in a closed mode, according to an embodiment of the present invention.
Figure 2:
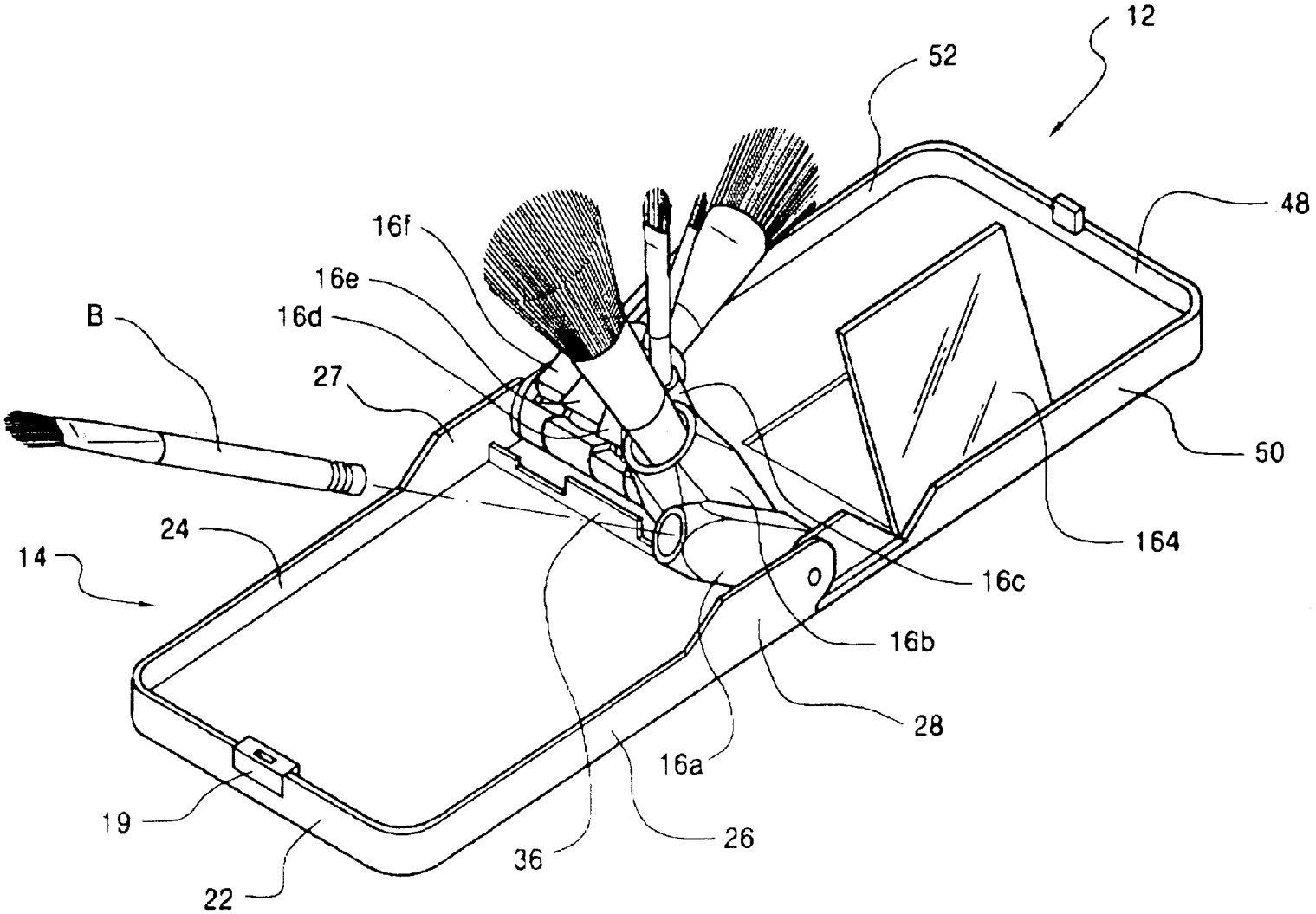
FIG. 2 is a perspective view of the cosmetic brush case of FIG. 1 in an open mode.
Figure 3:
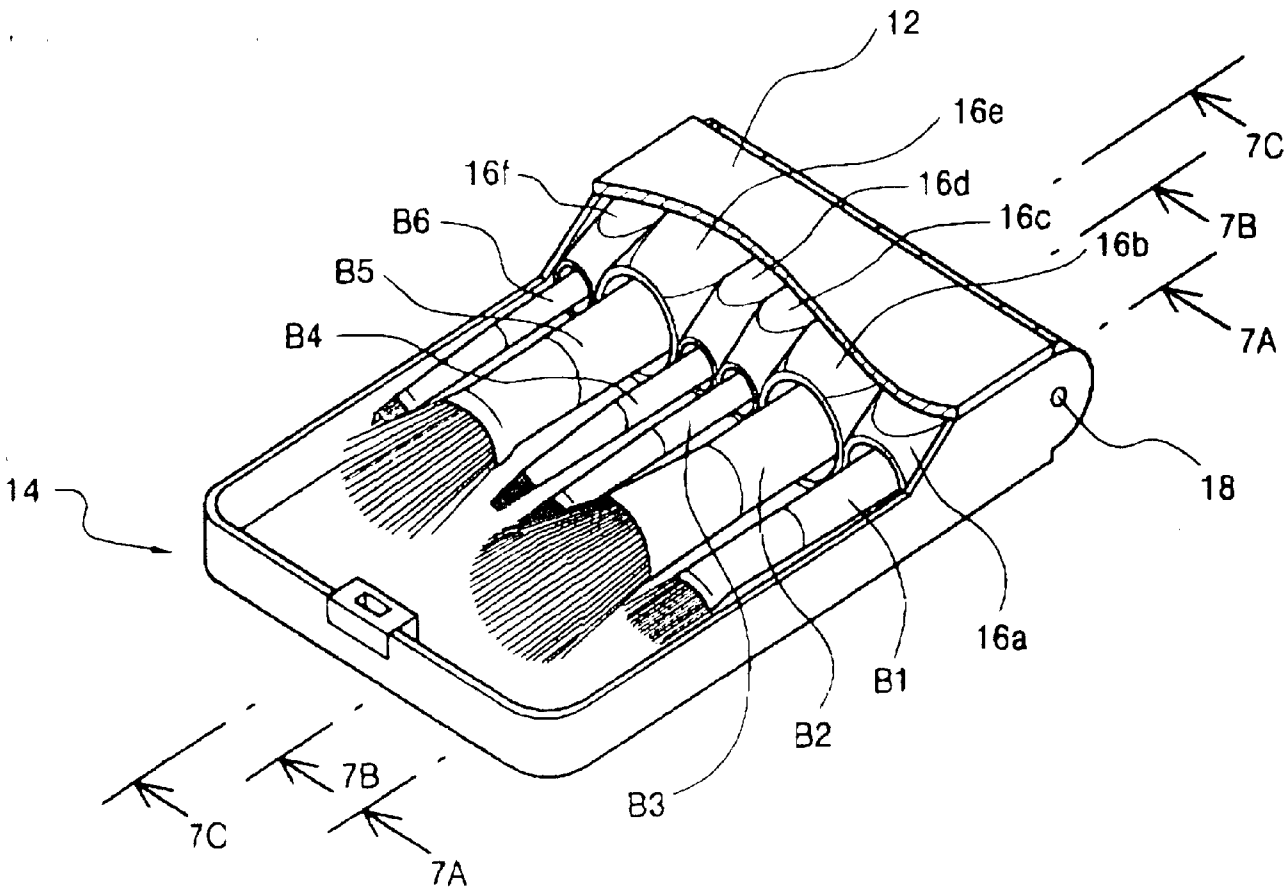
FIG. 3 is a perspective view of an upper cover of the cosmetic brush case of FIG. 1 in the closed mode, with a portion of an upper cover cut away partly.

FIG. 1 illustrates a perspective view of a cosmetic brush case in a closed mode according to an embodiment of the present invention. FIG. 2 illustrates a perspective view of the cosmetic brush case in an open mode. FIG. 3 illustrates a perspective view of a state that a cover is partly cut away to show the inside of the cosmetic brush case in the closed mode.

Referring to FIGS. 1 to 3, the cosmetic brush case 10 includes an upper cover 12, a lower cover 14 and a plurality of brush holders 16. The upper cover 12, the lower cover 14 and the brush holders 16 are assembled with a hinge pin 18 at a rear end portion of the case so as to allow them to rotate, which will be described in detail later. As shown in FIG. 2, when the covers 12 and 14 open, the brush holders 16 stand are spread in a fan shape. As shown in FIG. 3, when the upper cover 12 is closed, the brush holders 16 are arranged in a row side by side. In the closed mode, the upper cover 12 and the lower cover 14 are locked with each other through locking mechanism 19. The locking mechanism 19 may have the same structure as can be seen in a conventional cosmetic compact case.

Referring to FIGS. 1 to 4, the lower cover 14 includes a rectangular plate 20, a front rim 22, side rims 24 and 26 and side support walls 27 and 28. Each of side rims 24 and 26 and the front rim 22 are connected with each other. It is preferable that connected portions between the front rim 22 and each of the side rims 24 and 26 are finished round. Preferably, the height t of the front rim 22 and the side rims 24 and 26 is a half of a whole height T of the case 10 (see FIG. 1).

The side walls 27 and 28 are integrally formed to be connected at rear ends portions of the side rims 24 and 26, respectively. Each of the side supports 27 and 28 has an inclination 30. Each of the side walls 27 and 28 has a round end portion 32 which has the same curvature as that of rounded lower end portions of the brush holders 16. Each of the side walls 27 and 28 has a bore hole 34 so that the hinge pin 18 extends therethrough. The side wall 28 has an arc-shaped groove 35 at the inside surface thereof. The arc-shaped groove 35 receives a protrusion 82 formed at a side portion of a first brush holder 16*a*, which will be described below. The groove 35 has a similar shape to that of a groove of formed on each of a side wall of the upper cover 12 and the brush holders 16 which will be described below. The groove 35 extends to have a predetermined angle in the arc shape. The wall 28 has also a channel 37 connected to the groove 35 for facilitating the insertion of the protrusion 82 into the groove 35 therethrough.

Figure 4A:
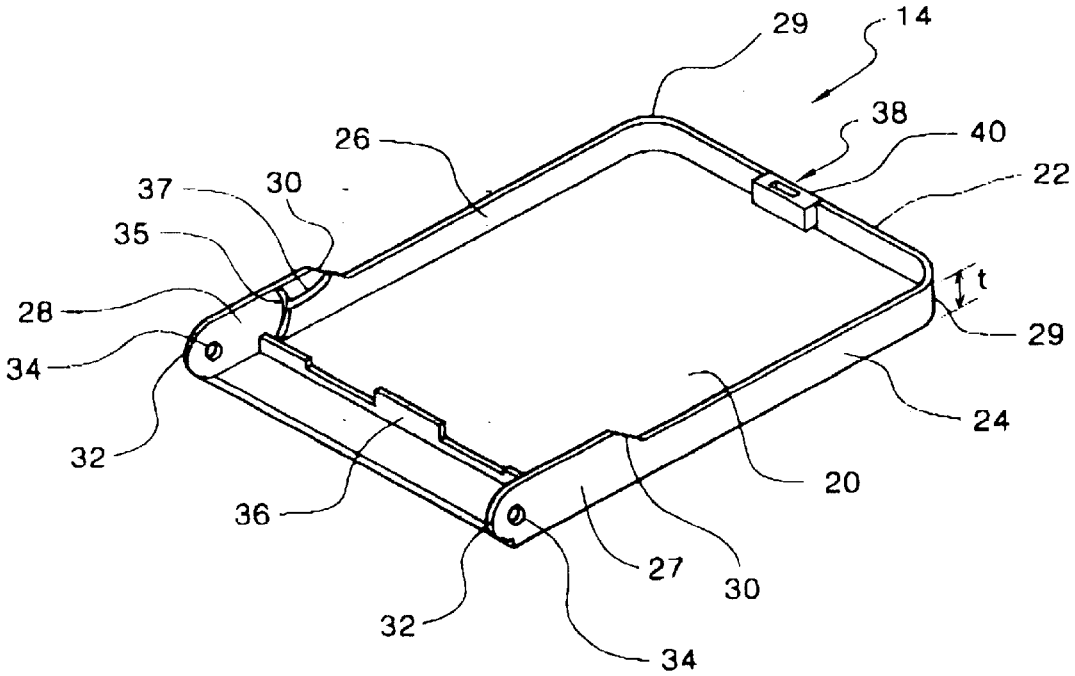
FIG. 4A is a perspective view of a lower cover of the cosmetic brush case of FIG. 1.

As shown in FIG. 4, a rib 36 is formed near the rear end portion of the plate 20 to extend between the opposing side walls 27 and 28. The rib 36 has a height depending on the size of the brushes B which is to be put into each brush holder 16 (see FIG. 7).

As shown in FIGS. 2 to 4, the locking mechanism 19 has a holding member 38. The holding member 38 has a hooking jaw at the inside of a hole and a push button. The holding member 38 engages with a barb member 42 formed at a front center portion of the upper cover 12. When the push button is pressed, the barb member 42 which is engaged with the holding member 38 is released. The above locking structure has been widely used in the conventional cosmetic compact case. It can be easily understood by those skilled in the art that the locking structure of the present invention is not limited to any specific known structure and that any other structure which allow the upper and lower covers locked and released can be used.

It is preferable that the plate 20, the front and side rims 22, 24 and 26 and the rib 36 of the lower cover 14 are made by way of an injection molding of plastic resin.

Referring to FIGS. 1 to 4, the upper cover 12 includes a rectangular plate 46, a front rim 48, opposing side rims 50 and 52, and opposing side support walls 54 and 56, which are preferably formed by way of the injection molding of plastic resin. Preferably, the upper plate 46 of the upper cover 12 has the same size and shape as those of the lower plate 20 of the lower cover 14. Each of the side rims 50 and 52 has an inclination 57 which extends to the inside surface of the upper plate 46. As can be seen in FIG. 1, the inclination 57 contacts with the inclination 30 of the lower cover 14 when the case is closed.

It is preferable that connected portion between the front rim 48 and each of the side rims 50 and 52 are finished round. Preferably, the height t of the front rim 48 and the side rims 50 and 52 is a half of the whole height T of the case 10 (see FIG. 1). The side walls 54 and 56 are arranged adjacent the rear end portions of the side rims 50 and 52. Each of the side walls 54 and 56 locates to be spaced from sides of the upper plate 46. A distance d between each side of the upper plate 46 and each side wall 50 or 52 corresponds to the thickness of the side wall 27 and 28 of the lower cover 14. Each of the side walls 54 and 56 has an inclination 60. The rear ends 62 of the side support walls 54 and 56 are finished round to have the same curvature as that of the arc-shaped lower end portion of each brush holder 16.

Each of the side walls 54 and 56 has a hole 64 so that the hinge pin 18 extends therethrough. It is preferable that the hole 64 is formed at the center of arc-shaped end portion 62 of each side wall. The side support 56 has an arc-shaped groove 65 at the inside thereof. The arc-shaped groove 65 receives a protrusion 66 formed at a side portion of a sixth brush holder 16*f* which will be described below. The wall 56 has also a channel 67 connected to the groove 65 for facilitating the inserting of the protrusion 66 into the groove 65 through the channel 67 during assembling.

As shown in FIGS. 2 to 4, the barb member 42, which is formed at the center of the front rim the upper cover 12, is engaged with the holding member 38 when the upper cover 12 is closed, as described above.

As shown in FIG. 3, the brush holders 16 for accommodating the brushes B are aligned in a row, in the closed mode of the case 10. Referring to FIGS. 2 and 5, first to sixth brush holders 16*a* to 16*f* are arranged in order from the side wall 54 to the side wall 56.

Figure 5A:
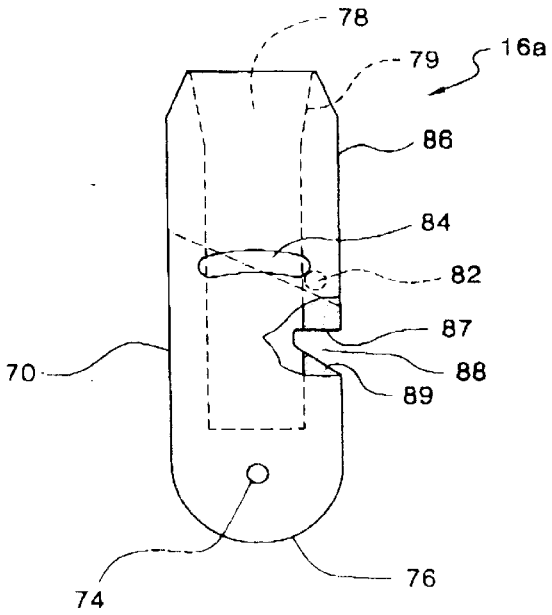
FIGS. 5A, 5C, 5E and 5G are front views
Figure 5B:
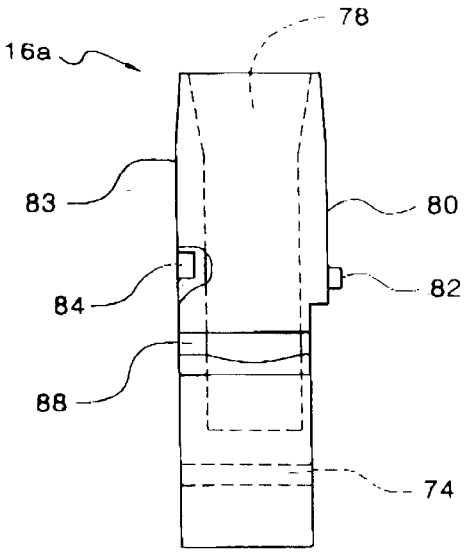
FIGS. 5B, 5D, 5F and 5H are side views of holders installed in the cosmetic brush case of FIG. 1.

FIG. 5A is a side view and FIG. 5B is a front view of the first brush holder 16*a*. The first brush holder 16*a* has a substantially rectangular body 70.

Alternatively, in other embodiment, the body has a cylindrical shape. A hinge pin insertion hole 74 is provided on the lower portion. An arc-shaped portion 76 is provided at the lowest end. Preferably, the pin insertion hole 74 is a center of the arc-shaped portion 76. The arc-shaped portion 76 has the same curvature as those of the round end portion 32 and the curved end portion 62 of the side support walls and arc-shaped portions of other holders 16*b* to 16*f*.

The first brush holder 16*a* has a hole or receptacle 78 extending in a longitudinal direction of the holder 16*a* for receiving the corresponding cosmetic brush. The receptacle 78 has an inlet 79 of a funnel shape facilitating the insertion of the brush into the receptacle 78.

A protrusion 82 extends from a first side 80 of the holder 16*a*. The protrusion 82 locates nearer to the lower cover 14 than the upper cover 12.

The protrusion 82 is received within the groove 35 of the lower cover 14 when assembling and moves along the groove 35 of the lower cover 14 when the upper cover 12 is operated. The first side 80 preferably has a stepped portion for providing a space for seating the side support wall 54 of the upper cover 12. A second side 83 of the first holder 16*a* has an arc-shaped groove 84 which centers the pin insertion hole 74.

The brush holder 16*a* has a rib insertion groove 88 formed at a front 86 directing toward the lower cover 14. The groove 88 extends from the first side 80 to the second side 83. The rib 36 of the lower cover 14 is inserted into the rib insertion hole 88 of the first brush holder 16*a*, which will be described below. It is preferable that an upper surface 87 of the rib insertion groove 88 is horizontal and a lower surface 89 of the rib insertion groove 88 slants for providing a rotation space for the rib 36 of the lower cover 14. The rib insertion groove 88 has a depth so that the inside of the receptacle 78 receiving the brush B1, that is, a portion of the Brush B1 received in the first brush holder 16*a*, is exposed. The relationship among the rib insertion groove 88, the brush B1 and the rib 36 will be described hereinafter.

Figure 5C:
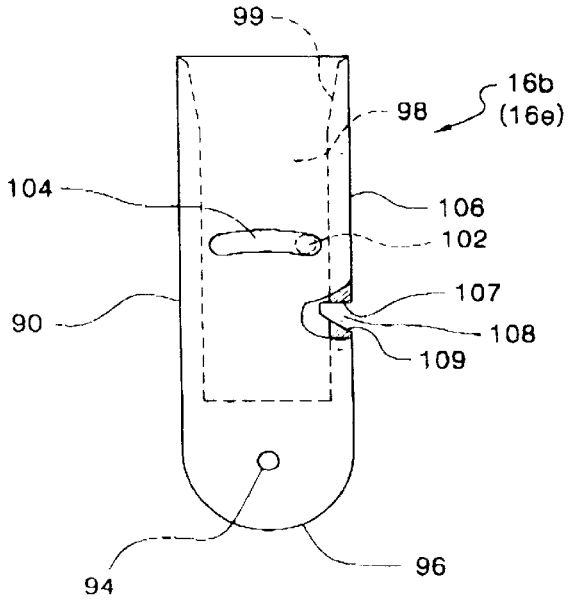
Figure 5D:
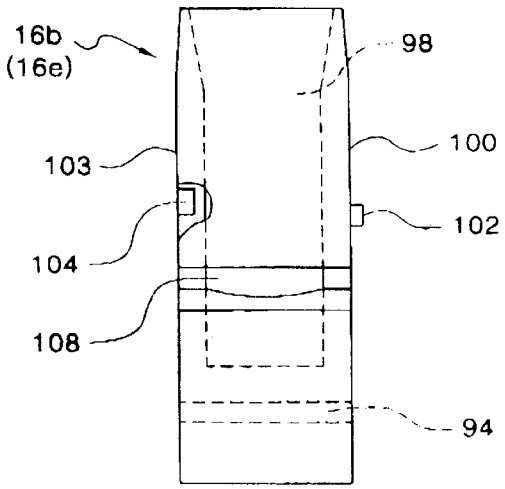

FIG. 5C is a side view and FIG. 5D is a front view of the second brush holder 16*b* and the fifth brush holder 16*e*. Since the second and fifth brush holders 16*b* and 16*e* have an identical shape and size, the second brush stand 16*b* will be described.

The second brush holder 16*b*, similarly to the first brush holder 16*a*, has a substantial rectangular body 90, a pin insertion hole 94, and an arc-shaped end portion 96. Preferably, the pin insertion hole 94 is the center of the arc of the portion 96.

The second brush holder 16*b* has a receptacle 98 for receiving the cosmetic brush. The receptacle 98 has a diameter larger than the corresponding brush B2. The receptacle 98 has an inlet 99 formed in a funnel shape.

A protrusion 102 extends from a first side 100 of the second brush holder 16*b*. The protrusion 102, when assembling, is inserted into the groove 84 formed at the first brush holder 16*a* adjacent to the second brush holder 16*b*, and moves along the groove 84 of the first brush holder 16*a* when the upper cover 12 rotates.

A second side 103 of the second brush holder 16*b* has an arc-shaped groove 104. A rib insertion groove 108 is formed at a front 106. The rib insertion groove 108 has a horizontal upper surface 107 and a slanted lower surface 109.

Figure 5E:
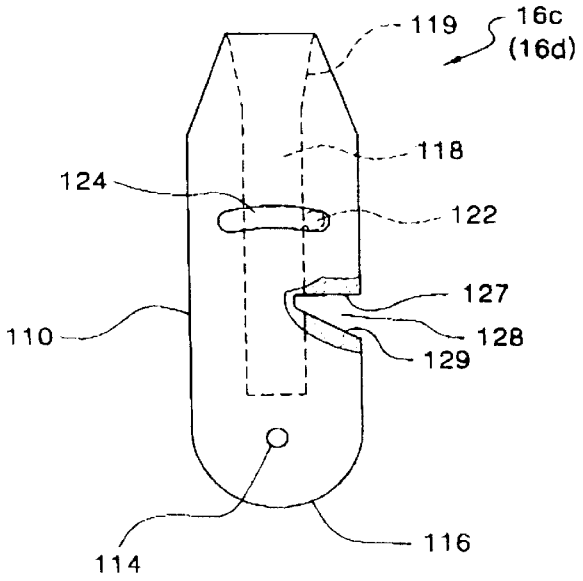
Figure 5F:
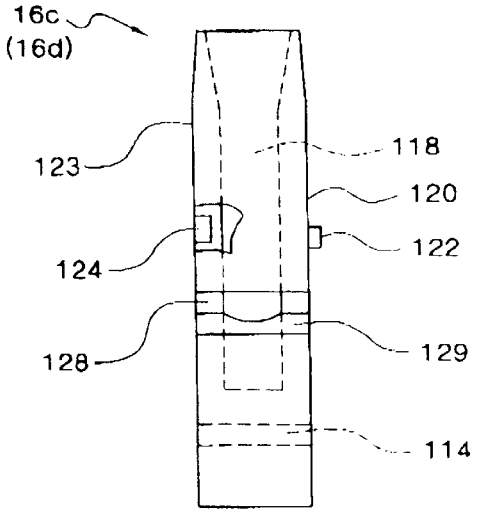

FIG. 5E is a side view, and FIG. 5F is a front view of the third brush holder 16*c* and the fourth brush holder 16*d*. Since the third and fourth brush holders 16*c* and 16*d* have an identical shape and size, the third brush holder 16*c* will be described now.

The third brush holder 16*c* has a rectangular body 110, a pin insertion hole 114, and an arc-shaped portion 116. The third brush holder 16*c* has a receptacle 118 for receiving the cosmetic brush B3. The receptacle 118 has a diameter larger than the corresponding brush B3. The receptacle 118 has an inlet 119 in a funnel shape.

A protrusion 122 is projected from a first side 120. The protrusion 122, when assembling, is received in the groove 104 of the second brush holder 16*b*. A second side 123 of the third brush holder 16*c* has an arc-shaped groove 124. A rib insertion groove 128 is formed at a front 126. The groove 128 has an upper horizontal surface 127 and a lower slanted surface 129.

Figure 5G:
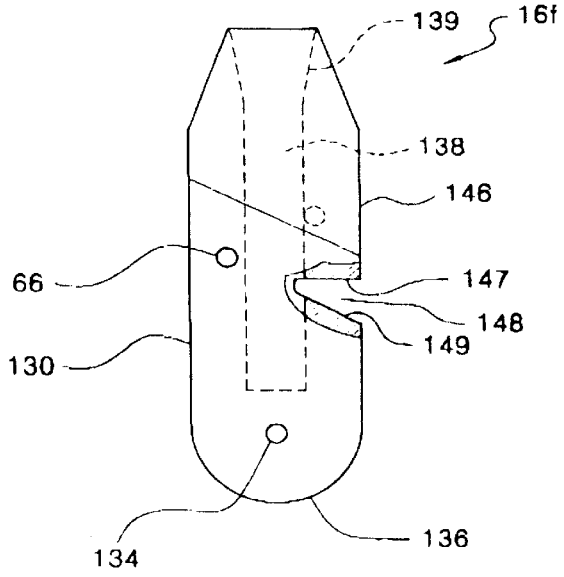
Figure 5H:
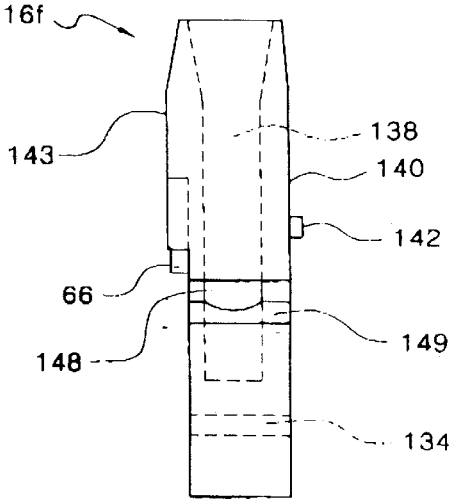
Figure 6A:
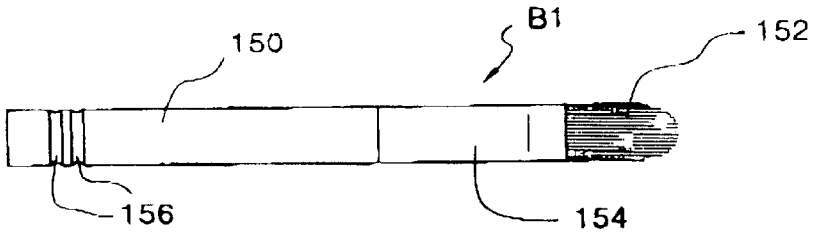
FIG. 6A to 6F are front views of brushes.
Figure 6B:
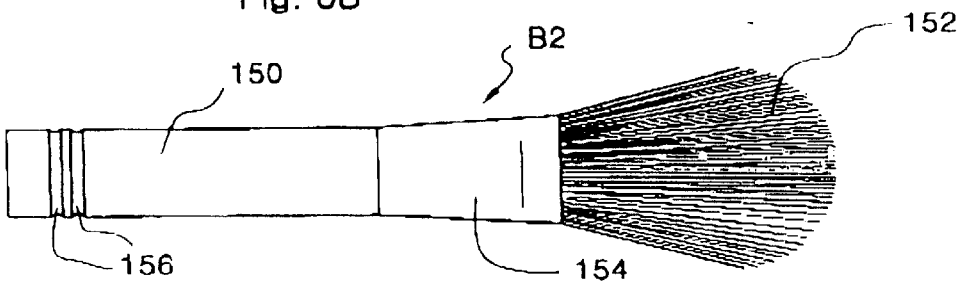
Figure 6C:
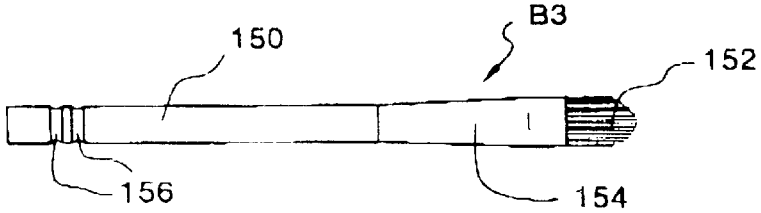
Figure 6D:
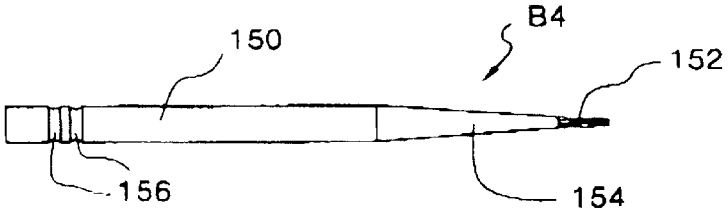
Figure 6E:
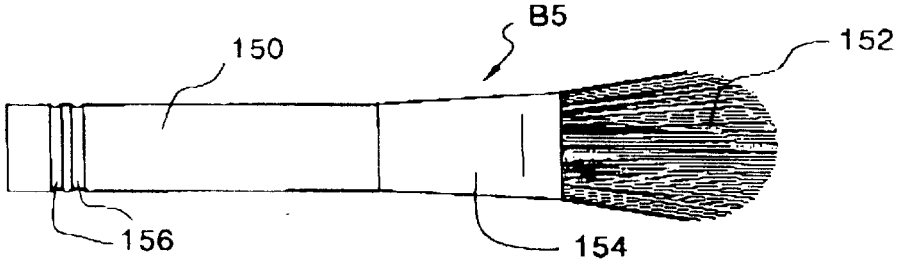
Figure 6F:
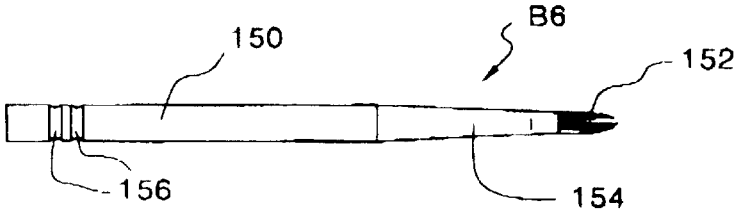

FIG. 5G is a side view and FIG. 5F is a front view of the sixth brush holder 16*f*. The sixth brush holder 16*f* has a rectangular body 130, a pin insertion hole 134 and an arc-shaped portion 136, which are configured to be same as the corresponding portions of other holders. The sixth brush stand 16*f* has a receptacle 138 having a diameter larger than that of the corresponding brush B6. The receptacle 138 has an inlet 139 formed in a funnel shape. A first protrusion 142 is projected from a first side 140 of the sixth brush holder 16*f* and locates nearer to the lower cover 14 than the upper cover 12. The first protrusion 142, when assembling, is received into the groove 104 formed at a fifth brush holder 16*e*, which is adjacent to the sixth brush holder 16*f*. The protrusion 142 moves along the groove 104 of the fifth brush holder 16*e* when the upper cover 12 is operated.

A stepped portion formed at a lower end portion of a second side 143 provides a space to place the side support wall 56 of the upper cover 12 when the case is closed. A second protrusion 66 is projected from the surface of the stepped portion. The second protrusion 66 locates near the upper cover 12. The second protrusion 66 is received within the arc-shaped groove 65 of the side support 56 of the upper cover 12 and moves along the arc-shaped groove 65.

The sixth brush holder 16*f* includes a receptacle 138. The sixth brush holder 16*f* has a rib insertion groove 148 formed at a front 146. The groove has an upper horizontal surface 147 and a lower slanted surface 149. The structure of the receptacle 138 and the rib insertion groove 148 of the sixth brush holder 16*f* is same as that of the corresponding portions of the third brush holder 16*c* and the fourth brush holder 16*d*.

Each of the brush holders 16*a* through 16*f* is manufactured by way of injection molding of plastic resin, preferably, engineering plastic resin. It is preferable that the protrusions 82, 102, 122 and 142 are made of metal and formed integrally with the corresponding brush holders 16 by way of insert molding.

Returning to FIGS. 2 and 3, the brush holders 16*a* to 16*f*, the upper cover 12 and the lower cover 14 are assembled. The side supports 54 and 56 of the upper cover 12 locates inside of the side supports 27 and 28 of the lower cover 14. The first brush holder 16*a* is arranged at the inside of and adjacent the side support 54 of the upper cover 12. The stepped portion of the first side 80 of the first brush holder 16*a* faces toward the side support wall 54 of the upper cover 12. The protrusion 82 is inserted into the arc-shaped groove 35 of the side wall 28 of the lower cover 14. And then, the second brush holder 16*b*, the third brush holder 16*c*, the fourth brush holder 16*d*, the fifth brush holder 16*e* and the sixth brush holder 16*f* are aligned in order. First side portions of the brush holders 16*b*, 16*c*, 16*d*, 16*e* and 16*f* face to second side portions of the adjacent brush stand holder 16*a*, 16*b*, 16*c*, 16*d* and 16*e*, respectively. The protrusion formed on the first side of each of the brush holders is received within each arc-shaped groove of the second side of the adjacent brush holder. The second side 143 of the sixth brush holder 16*f* faces to the side support 56 of the upper cover 12 and the protrusion 66 of the second side 143 of the holder 16*f* is received within the arc-shaped guide groove 65 of the side support 56.

FIG. 6 illustrates six kinds of brushes B1 to B6. The first brush B1 is put in the first brush holder 16*a* and the second brush B2 is put in the second brush holder 16*b*. The third to sixth brushes B3 to B6 are put in the third to sixth brush stands 16*c* to 16*f*, respectively. Each of the brushes B1 to B6 includes a cylindrical grip 150, a hair portion 152 and a metal member 154 for connecting the grip 150 and the hair portion 152 and for holding the hair portion. The grip 150 has at least one or more annular grooves 156 formed at the lower portion.

Figure 7A:
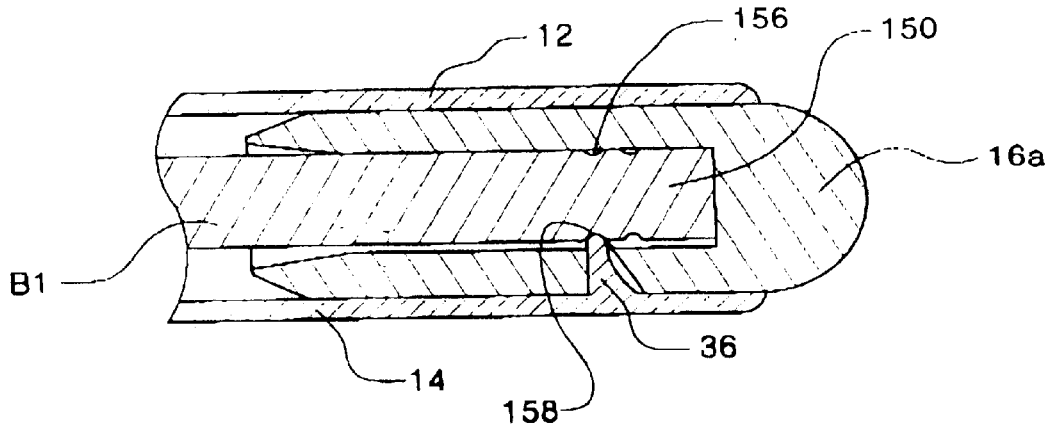
FIGS. 7A to 7C are cross-sectional views of the holders, the brushes and a rib, illustrating a state that each brush is protected from being pulled out.

FIG. 7 is a sectional view illustrating the relationship among the rib 36 of the lower cover 14, the brush holders 16 and the brushes B in the closed mode. FIG. 7A illustrates the relationship between the first brush holder 16*a* and the rib 36. The rib 36 of the lower cover 14 is inserted into the rib insertion groove 88 and a first end portion 158 of the rib 36 is engaged with the annular groove 156 of the first brush B1. Therefore, the brush B1 is retained without separation from the first brush holder 16*a* in the closed state of the case 10.

Figure 7B:
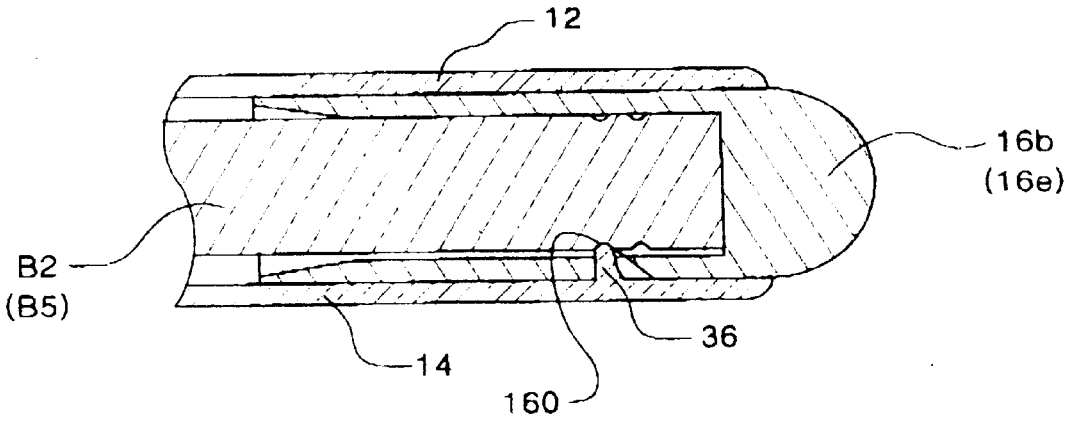

FIG. 7B illustrates the relationship among each of the second and fifth brush holders 16*b* and 16*e*, the rib 36, and each of the corresponding brushes. The rib 36 of the lower cover 14 is inserted into the rib insertion groove 108 and a second end portion 160 of the rib 36 is engaged with the groove 156 of the brush B2 or B5.

Figure 7C:
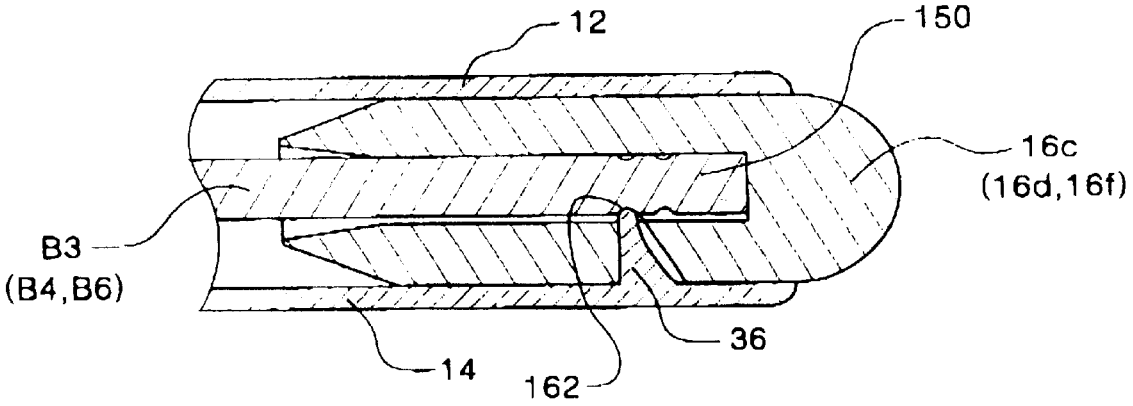

FIG. 7C illustrates the relationship among each of the third, fourth and sixth brush stands 16*c*, 16*d* and 16*f*, the rib 36 and each of the corresponding brushes. The rib 36 of the lower cover 14 is inserted into the rib insertion groove 128 and a third end portion 162 of the rib 36 is engaged with the annular groove 156 of the third brush B3, B4 or B6.

Figure 4B:
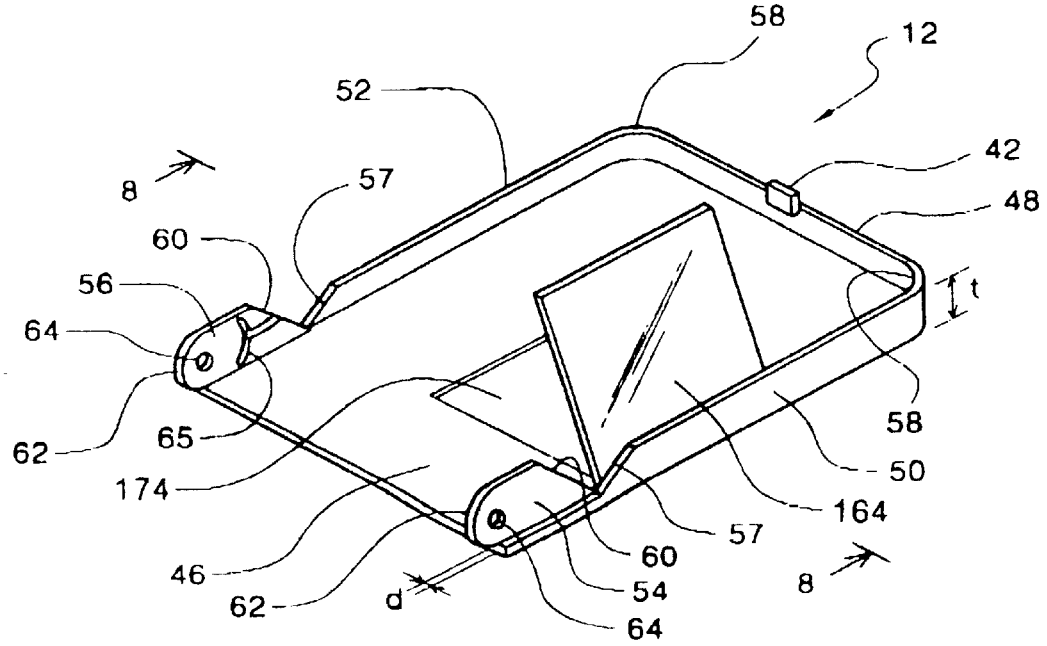
FIG. 4B is a perspective view of an upper cover of the cosmetic brush case of FIG. 1.
Figure 8:
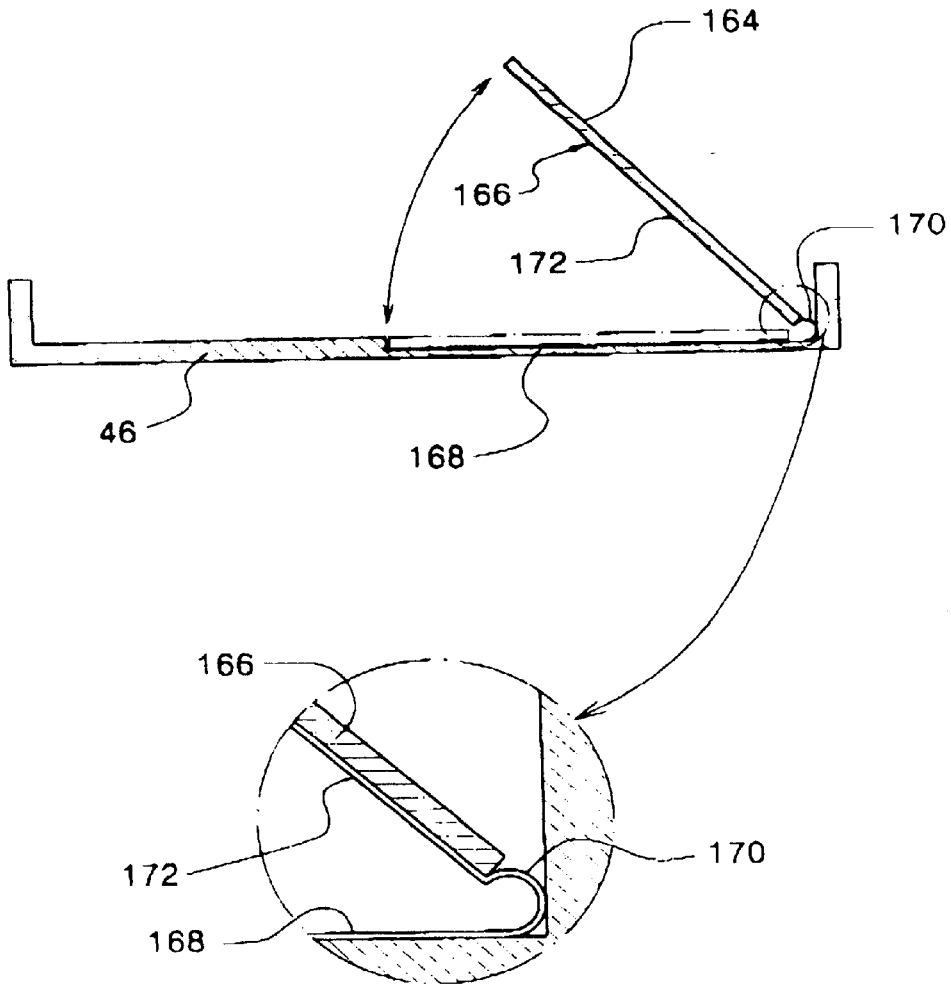
FIG. 8 is a cross-sectional view of mirror configuration, illustrating an operation of a mirror of the cosmetic brush case; and, FIG. 9 is a side view of the case illustrating the geometric relation ship of covers and brush holders in the open state.

FIG. 8 is a sectional view along the line 8—8 FIG. 4B. The upper plate 46 of the upper cover 12 has a mirror 164. The mirror 164 is attached to a resilient support 166, which is preferably made of a metal plate spring material, such as stainless steel, phosphor bronze, or the likes. The resilient support 166 includes a bottom portion 168, a resilient portion 170 and a mirror support portion 172.

Meanwhile, the upper plate 46 of the upper cover 12 has a stepped portion 174 formed at the inside thereof (see FIG. 4B). The portion 174 has an enough depth and area so that the mirror 164 can seat within the portion 174 when the case 10 is closed. The bottom portion 168 is fixed on the portion 174. The resilient portion 170 is round. The mirror 164, which may be made of glass, is attached to the flat mirror support portion 172. It will be appreciated that the mirror 164 may be made of a metal plate, such as aluminum plate electroplated.

Referring to FIGS. 1 to 9, operation of the present invention will now be described in detail.

As shown in FIGS. 1 and 3, the brush holders 16 are arranged side by side in the closed mode. At this state, the protrusion 82, 102, 122 or 142 of each brush holder 16 received in the corresponding arc-shaped groove 35, 84, 104, or 124 locates at a position of the groove near the lower cover 14, while the protrusion 66 of the second side 143 of the sixth brush holder 16*f* locates at a position of the groove 65 near the upper cover 12.

In the closed mode, the upper cover 12 and the lower cover 14 are locked with each other by way of the locking mechanism 19 and keep the closed state. The end portions of the rib 36 in the lower cover 14 are engaged with the grooves 156 formed at the lower portion of the grip of the brushes B. The above structure prevents the brushes B from being pulled out of the brush holder 16, even when the hair portion 152 is directed to the ground. Therefore, the hair portion 152 of the brush B is protected from damage.

To open the case 10, the locking state of the locking mechanism is released. When the upper cover 12 and the lower cover 14 are released from the locked state, the upper cover 12 may be lifted up slightly by way of the force of the resilient support member 170 on which the mirror 164 is attached. When the upper cover 12 rotates continuously, the protrusion 66 of the second side portion 143 of the sixth brush holder 16*f* reaches the distal end of the arc-shaped groove 65 of the side support 56 of the upper cover 12. If the upper cover 12 rotates further after the protrusion 66 reaches to the distal end of the arc-shaped groove 65, the sixth brush holder 16*f* rotates together with the upper cover 12.

During the rotation of the sixth brush holder 16*f*, the sixth brush holder 16*f* and the fifth brush holder 16*e* are spread out and the angle therebetween increases gradually. At this operation, the protrusion 142 of the first side 140 of the sixth brush holder 16*f* moves within the arc-shaped groove 104 of the second side 103 of the fifth brush holder 16*e*. After the protrusion 142 reaches the end of the arc-shaped groove 104, the fifth brush holder 16*e* rotates together with the sixth brush holder 16*f* and the upper cover 12.

In the meantime, the fifth brush holder 16*e* and the fourth brush holder 16*d* are spread out during the rotation of the fifth brush holder 16*e* and the angle therebetween increases gradually. At this operation, the protrusion 102 of the first side 100 of the fifth brush holder 16*e* moves within the arc-shaped groove 124 of the second side 123 of the fourth brush holder 16*d*. After the protrusion 102 reaches the end of the arc-shaped groove 124, the fourth brush holder 16*d* rotates together with the fifth brush holder 16*e*.

Figure 9:
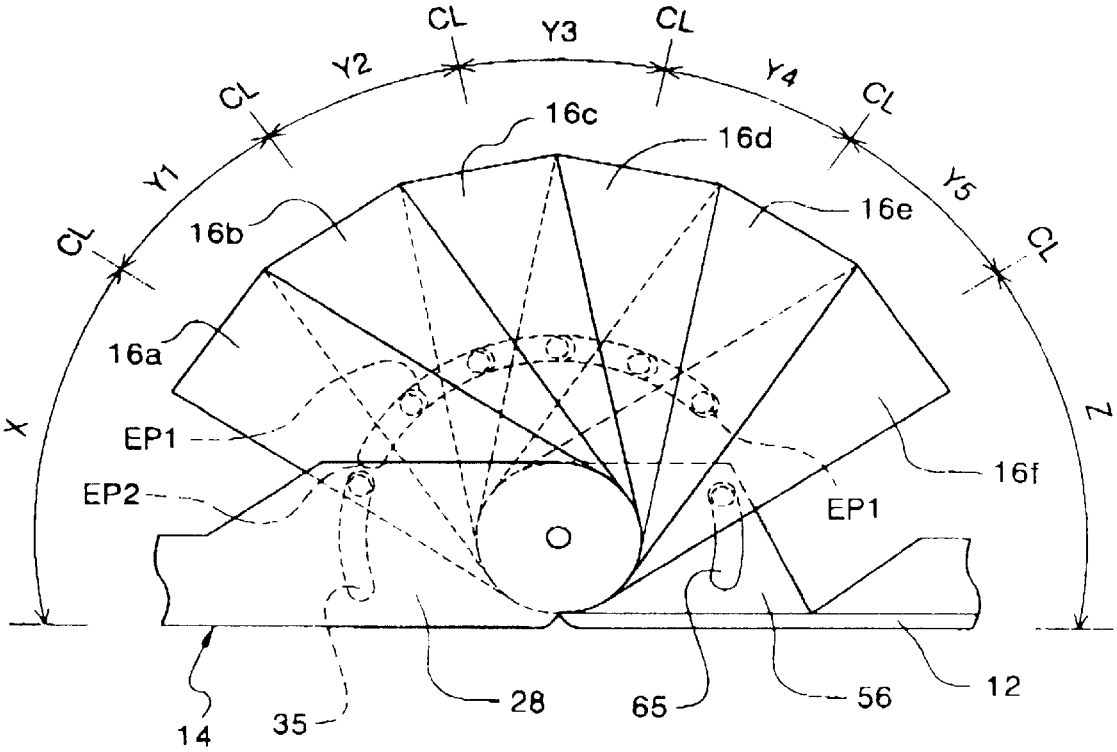

In the same manner, the fourth brush holder 16*d*, the third brush holder 16*c*, the second brush holder 16*b* and the first brush holder 16*a* rotate and are spread out during rotation. When the first brush holder 16*a* rotates, the protrusion 82 of the first side 80 of the first brush holder 16*a* moves within the arc-shaped groove 35 of the side support wall 28 of the lower cover 14. When the protrusion 82 reaches the end of the arc-shaped groove 35, an angle between the upper cover 12 and the lower cover 14 becomes 180 or more degrees. FIGS. 2 and 9 illustrate an entirely spread state of the covers 12 and 14.

Referring to FIG. 9, it is preferable that angle between two adjacent brush holders 16 is 20 degrees when the case 10 is unfolded completely. An angle X between the first brush holder 16*a* and the upper cover 12 is 40 degrees and an angle Z between the sixth brush holder 16*f* and the lower cover 14 is 40 degrees. In this embodiment shown in FIG. 9, it was explained that an angle between the upper cover 12 and the lower cover 14 in the spread state is 180 degrees. However, when the covers 12 and 14 are fully spread, the angle between the upper cover 12 and the lower cover 14, that is, the summation of angles X, Y1 through Y5 and Z, is preferably greater than 180 degrees, for example, 182 degrees. The above angle more than 180 degrees permits both the upper cover 12 and the lower cover 14 to contact sufficiently with a surface on which the unfolded case 10 is put, even when the surface is uneven. To this end, the angle X or Z between each of the cover 12 and 14 and the adjacent brush holder 16 is configured to be 41 degree, when the covers 12 and 14 are completely spread.

In case of the angles X, Y1 to Y5 and Z are determined, those skilled in the art can easily determine the locations of the protrusions and of the arc-shaped grooves corresponding to the protrusions based on the above description.

Referring to FIG. 9, an angle between a center line CL of a brush holder 16 and a line connecting the rotation axis and the protrusion 102, 122 or 142 is designed to be 10 degrees. An angle between the center line CL and a line connecting a first end portion EP1 of the arc-shaped groove 84, 104 or 124 of the adjacent brush holder and the rotation axis is designed to be 10 degrees. Then, the adjacent brush holders will spread at 20 degrees in unfolded state. To adjust the spread angle between the adjacent holders, locations either the protrusion or the end portion EP1 may be changed. It is preferable that an angle between the center line CL and the line connecting a second other end portion EP2 of the arc-shaped groove 84, 104 or 124, i.e., is greater than 10 degrees. If the angle is less than 10 degrees, the brush holders 16 cannot be arranged evenly when the case 10 is folded. In another embodiment, the arc-shaped groove may extend so that the second end of the groove is opened.

It can be appreciated that the number of the brush holders is not limited to six and the number of the brush holders can be varied. It is preferable to determine the angle between the adjacent brush holders in the unfolded mode depending on the number of the brush holders. In addition, it will be appreciated that the brush holders can be designed to receive various kinds of brushes and the order of the brush holders may be changed.

In the embodiment described above, the spread angles between the adjacent brush holders are identical, however, the brush holders may be spread at different angles.

In the mean time, it is described in the above embodiment that, when the case is unfolded, the brush holders are spread by way of the configuration of the protrusions and the grooves having arc shape and the closed end portions. However, the present invention should not be limited by the arc shape. A space allowing the protrusion to move freely and a detenter or a stopper for stopping the movement of the protrusion at a predetermined location may be provided. The configuration of the space and the detenter allows that one of two adjacent brush holders moves within a certain angle range, and then, the two adjacent brush holders move together.

In the embodiment described above, the protrusions and grooves locate at area between the hinge pin and the upper end of the holders. Alternatively, the protrusions and grooves are designed to locate at area between the hinge pin and rounded end portions of the holders. The grooves may locate at area between the hinge pin and the rounded end portions of the support walls.

It can be understood that another device may be used instead of the arc-shaped groove and the protrusion for spreading the brush holders. In a further embodiment, the adjacent brush holders are connected by a string for spreading the brush holders depending on the movement of the cover.

Meanwhile, it is previously explained that the rib continuously extends between the opposite side rims. Alternatively, in a further another embodiment, the rib can be substitute with plural projections cooperating with the grooves of the holders. Those skilled in the art can easily understand that any other structure for preventing the separation of the brushes from the holder may be applied to the present invention instead of the configuration of the rib and the groove of the brush.

The grip of the brush may be formed in a rectangular shape or a pentagonal shape. However, It can be appreciated that the brush holder may have a cylindrical body and the receptacle may be varied according to the shape of the grip of the cosmetic brush.

Advantageous effects according to the present invention will be described below.

When the cosmetic brush case is unfolded, the brush holders spread in a fan shape. Therefore, a user can easily access a certain brush with his or her finger, owing to spaces formed between the spread brush holders. When the brush holders are spread, each brush holder containing corresponding brush locates in its own position. It allows user to find easily a specific brush. The cosmetic brush case becomes compact when folded. The covers of the case have stiffness to bear outer influence so that the brushes retained within the case maintain their original shapes when the case is carried. When the case is closed after using, the inside of the case is completely sealed to prevent dust from flowing into. When the case is unfolded, the brushes cannot be pulled out from the brush holder by way of the engagement of the rib and grooves formed on the brushes so that the hair portion of the brush is protected from damage. When the case is opened, the upper and lower covers serve as a base to provide stability as shown in FIG. 2.

According to the present invention, by a simple step of operation, the case can be opened and the brush holders are spread out to be ready for use of the brushes. Additionally, the case can be closed and folded by a simple step of operation. As the case is compact when closed, it is convenient for carrying.

Although the invention has been shown and described with respect to the exemplary embodiments, it should be understood that various changes, modifications and additions might be made without departing from the spirit and scope of the invention.

What is claimed is:

1. A cosmetic brush case comprising a plurality of devices linearly arranged, each device comprising a holder for holding a cosmetic brush, each device being individually pivoted about an axis and engaged with an immediately neighboring device such that a pivotal movement of each device about an axis thereof more than a selected angle in a direction causes a pivotal movement of the immediately neighboring device thereof in the same direction.

2. The cosmetic brush case as defined in claim 1, wherein the plurality of the devices are arranged in a row, and the axis of each device is aligned along the row.

3. The cosmetic brush case as defined in claim 1, wherein the holder comprises a columnar hollow adapted to receive a cosmetic brush.

4. The cosmetic brush case as defined in claim 3, wherein the columnar hollow is configured to hold the cosmetic brush.

5. The cosmetic brush case as defined in claim 3, wherein the columnar hollow is configured to receive a cylindrical portion of the cosmetic brush.

6. The cosmetic brush case as defined in claim 1, wherein each device comprises a wall opposing an immediately neighboring device, and the wall comprises either a guide groove or a protrusion toward the immediately neighboring device.

7. The cosmetic brush case as defined in claim 6, wherein the guide groove is configured to receive the protrusion of the immediately neighboring device.

8. The cosmetic brush case as defined in claim 7, wherein the protrusion of the immediately neighboring device is allowed to move along the guide groove.

9. The cosmetic brush case as defined in claim 7, wherein the guide groove is arc-shaped.

10. The cosmetic brush case as defined in claim 1, wherein two devices at both distal ends of the plurality of the linearly arranged devices have only one immediately neighboring device.

11. The cosmetic brush case as defined in claim 10, further comprising:

a first body; and a second body hinged on the first body so that the first or second body can rotate with respect to the other between first and second positions, the first position being a state where the first and second bodies are completely folded, the second position being a state where either the first body or the second body is rotated less than 360° from the first position;

wherein the plurality of the linearly arranged devices comprise a first device located at one of the two distal ends of the linear arrangement and a second device located at the other distal end thereof; and wherein the first device is connected to the first body, and the second device is connected to the second body, whereby a rotational movement of the first body with respect to the second body can cause pivotal movement of the plurality of the devices.

12. The cosmetic brush case as defined in claim 11, wherein at the second position, either the first body or the second body is rotated from about 170° to about 190°0 from the first position.

13. The cosmetic brush case as defined in claim 12, wherein at the second position, either the first body or the second body is rotated from about 180° to about 185° from the first position.

14. The cosmetic brush case as defined in claim 11, wherein at the first position, the first and second bodies form an enclosed space therebetween, wherein the plurality of the devices are arranged in the enclosed space.

15. The cosmetic brush case as defined in claim 11, wherein the second body is hinged on the first body by a hinge pin, and the hinge pin provides the axis of each of the plurality of the devices, whereby the plurality of the devices are rotatable about the hinge pin.

16. The cosmetic brush case as defined in claim 11, further comprising a brush having an elongated handle, wherein the plurality of devices comprises a brush holder having a columnar hollow for receiving the brush handle.

17. The cosmetic brush case as defined in claim 16, wherein the first body comprises a rib, the brush handle comprises a groove, and the brush holder comprises an opening on a wall toward the first body, wherein the rib and opening are configured so that the groove of the brush handle can be engaged with the rib of the first body via the opening when the first and the second bodies are at the first position.

18. The cosmetic brush case as defined in claim 16, wherein the handle of the brush is configured to be engaged with the first body when the first and second bodies are at the first position.

19. A method of operating the cosmetic brush case of claim 11, comprising:

rotating the first body with respect to the second body toward the second position of the first and second bodies; and the first device connected to the first body following the rotation of the first body, thereby causing an immediately neighboring device to follow the first device when the first device rotates more than a selected angle following the first body.

20. A cosmetic brush case for retaining plural brushes, the cosmetic brush case comprising:

a first cover;

a second cover coupled to the first cover and rotatable about an axis with respect to the first cover; and a plurality of brush holders arranged along the axis, wherein each holder is rotatably arranged about the axis, wherein each holder is coupled with one or two immediately neighboring holders such that rotation of a holder beyond a selected angle in a direction causes rotation of at least one of the immediately neighboring holders in the same direction, wherein when the case is open, the holders are spread out.

21. A cosmetic brush case for retaining plural brushes, the cosmetic brush case comprising:

a housing comprising first and second covers connected along an axis of rotation; and a plurality of brush holders arranged along the axis, wherein two holders located at distal ends of the axis are connected with one of the first and second covers, and wherein each holder is coupled with one or two immediately neighboring holders, whereby the holders can be fanned out when the first and second covers are rotatably opened.

* * * * *